US007703974B2

(12) United States Patent
Bouille

(10) Patent No.: US 7,703,974 B2
(45) Date of Patent: Apr. 27, 2010

(54) REVERSIBLE WATCH

(76) Inventor: Eric Bouille, La Marnière 57, Hauterive (CH) 2068

( * ) Notice: Subject to any disclaimer, the term of this patent is extended or adjusted under 35 U.S.C. 154(b) by 1111 days.

(21) Appl. No.: 10/538,668

(22) PCT Filed: Feb. 25, 2003

(86) PCT No.: PCT/IB03/00688

§ 371 (c)(1),
(2), (4) Date: Jun. 10, 2005

(87) PCT Pub. No.: WO2004/055602

PCT Pub. Date: Jul. 1, 2004

(65) Prior Publication Data

US 2006/0126445 A1 Jun. 15, 2006

(30) Foreign Application Priority Data

Dec. 12, 2002 (CH) ..... 2121/02

(51) Int. Cl.
*A44C 5/00* (2006.01)
*G04B 37/00* (2006.01)

(52) U.S. Cl. ..... 368/281; 368/282; 224/164; 224/167; 224/169

(58) Field of Classification Search ..... 368/281, 368/282; 224/164, 167, 169; 24/163 K, 24/265 B, 265 WS
See application file for complete search history.

(56) References Cited

U.S. PATENT DOCUMENTS 1,718,821 A * 6/1929 Herschede ..... 24/574.1
1,769,245 A * 7/1930 Tregoning ..... 174/138 B
2,051,591 A * 8/1936 Brogan ..... 24/116 A
5,398,218 A * 3/1995 Munnier et al. ..... 368/282
6,176,612 B1 * 1/2001 Chagnoux ..... 368/282
6,360,404 B1 * 3/2002 Mudge et al. ..... 24/3.4
6,712,501 B2 * 3/2004 Kinkio et al. ..... 368/281
6,779,917 B1 * 8/2004 Chappuis ..... 368/282
2006/0114752 A1 * 6/2006 Saunier ..... 368/281

FOREIGN PATENT DOCUMENTS

| | | |
|---|---|---|
| CH | 659 167 | 1/1987 |
| CH | 674 291 | 5/1990 |
| FR | 2 357 202 | 2/1978 |
| FR | 2 741 964 | 6/1997 |
| GB | 2 213 612 | 8/1989 |

* cited by examiner

*Primary Examiner*—Edwin A. Leon
(74) *Attorney, Agent, or Firm*—Finnegan, Henderson, Farabow, Garrett & Dunner

(57) ABSTRACT

The invention concerns a device enabling reversibility and interchangeability of an object, such as a watch and a wrist watch, comprising at least one reversible and interchangeable element (110, 111) including a cavity (120, 121) and a removable projecting fixing element (203) integral with the bracelet or other support to be inserted axially parallel or not and to be moved in parallel with the element to the cavity (120, 121) up to a stop position and brought by rotation into its fixing position. The removable fixing element (203) can be made in different embodiments desired by a user. The device comprises a cavity in the middles (110, 111) wherein is housed the base (210) of a pivot (211) of the removable fixing element (203) which is integral with one end of the bracelet (204), whereby a rotational motion is imparted to a watch case (100, 104) and to its bracelet (204), independently of each other, so as to provide a watch with interchangeable double dial and a double-sided bracelet.

20 Claims, 7 Drawing Sheets

28

REVERSIBLE WATCH

The present invention relates to horology and more particularly to systems for making an object such as a watch reversible and interchangeable relative to a support such as a strap.

It is well known that watches are held on the wrists of users by straps. The straps must be strong and securely fixed to the watch case without neglecting their decorative role which must be in perfect harmony in both color and form. Designers are constantly alert to the views of an increasingly demanding clientele, for whom they create products which take on board the above criteria.

Straps may be welded, in which case they are generally made of the same material as the case, or "removable" and made of metal, synthetic material or leather. Removable straps are often attached by spring bars which lock into lugs of the watch case.

Users of watches are showing an increasing interest in modular systems allowing them to transform their watches into, for example, jewelry, in which case they emphasize the decorative aspect of what they are wearing, or into a dual dial for a two-sided watch.

To give a rotary movement to a two-sided watch it is known practice to use a construction as explained in the publication CH 659167, which attaches the fixing loops of a strap to bearings on a watch case, on which these loops pivot.

It is an object of the present invention to provide a system for enabling a watch movement and/or a strap to be reversed independently of each other, thereby providing in particular an interchangeable dual-dial watch and an interchangeable two-sided strap.

This object is achieved with a system for making an object such as a watch and a watch strap reversible and interchangeable, characterized in that it comprises at least one reversible and interchangeable element comprising a cavity and a removable fixing element projecting from and attached to the strap or other support so that it can be inserted axially, parallel or otherwise, and is moved parallel to the cavity to a stop position where it is rotated into its fixed position.

The present invention applies to all types and forms of watches or comparable objects. The distinguishing features of the device for enabling in particular a watch to be reversed are that the watch and strap can be reversed independently of each other without pivots integral with the watch case, and that the elements are interchangeable should the user wish to modify the arrangement of the constituent elements or replace them.

A system for making in particular a watch reversible and interchangeable relative to a strap is composed advantageously of two watch cases joined together and a strap at whose ends are two removable fixing elements.

The watch cases are joined together by for example four screws inserted via the dial side of the first case and fixed usually into the bottom of the second case.

The composite case assembly has two opposing cavities milled into the middles of the cases on the sides to which the strap ends are to be fixed.

The strap enables joining of the watch case assembly, or separation to make it interchangeable, by means of the removable fixing elements which serve as pivoting points for said watch case assembly, should the user wish to display one or other of the dials, or to reverse the strap should he wish to reverse the strap only to expose one or other of its sides.

Notice that in one version, the user has available an assembly having on one side a watch case and on the other a decorative item such as an engraved plate.

The system of the invention is moreover mounted on a watch in which the watch case is reversible and interchangeable or is composed of an assembly of two cases. In this version the support is a watch strap.

At each end of the strap is a fixing element with a pivot which fits into the lateral cavity in the watch case middles. A sideways movement situates the pivot in its fixed position and a rotation locks the device by means of two retractable balls situated at the ends of each removable fixing element, which fit into cavities situated for example in the lugs of the case middles.

The invention will be more easily understood from the following description, given by way of example, which refers to the appended drawings, in which.

Figure 7:
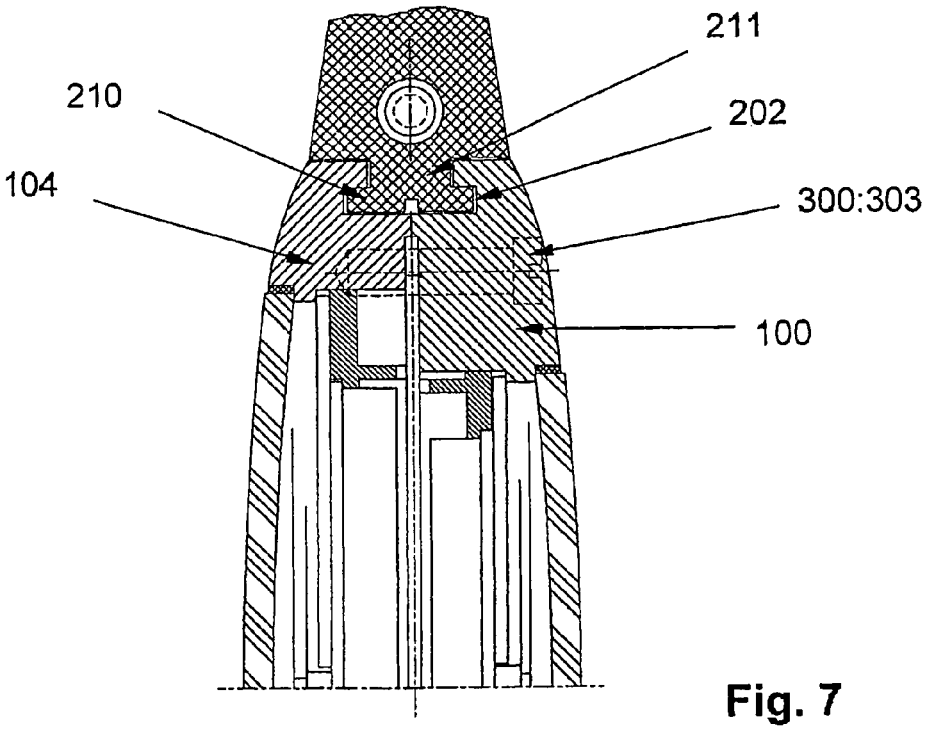
FIG. 7 is a longitudinal section through an assembly of two watch cases into which a fixing element is inserted.
Figure 10:
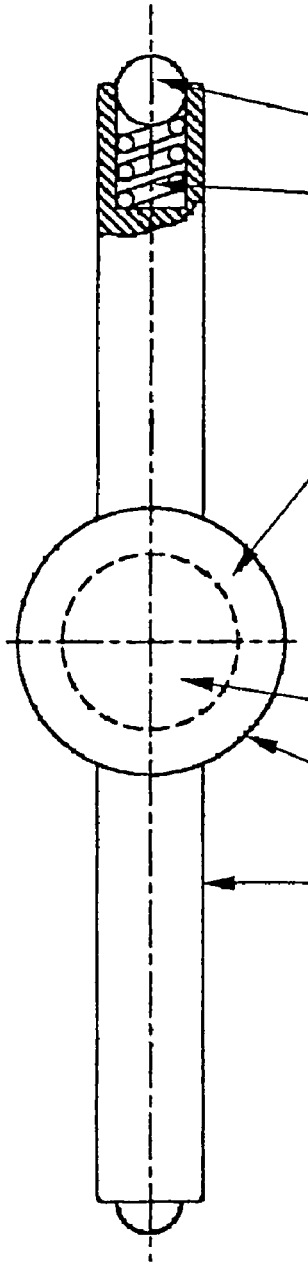
FIG. 10 is a side view, with partial cross section, of a fixing element.
Figure 11:
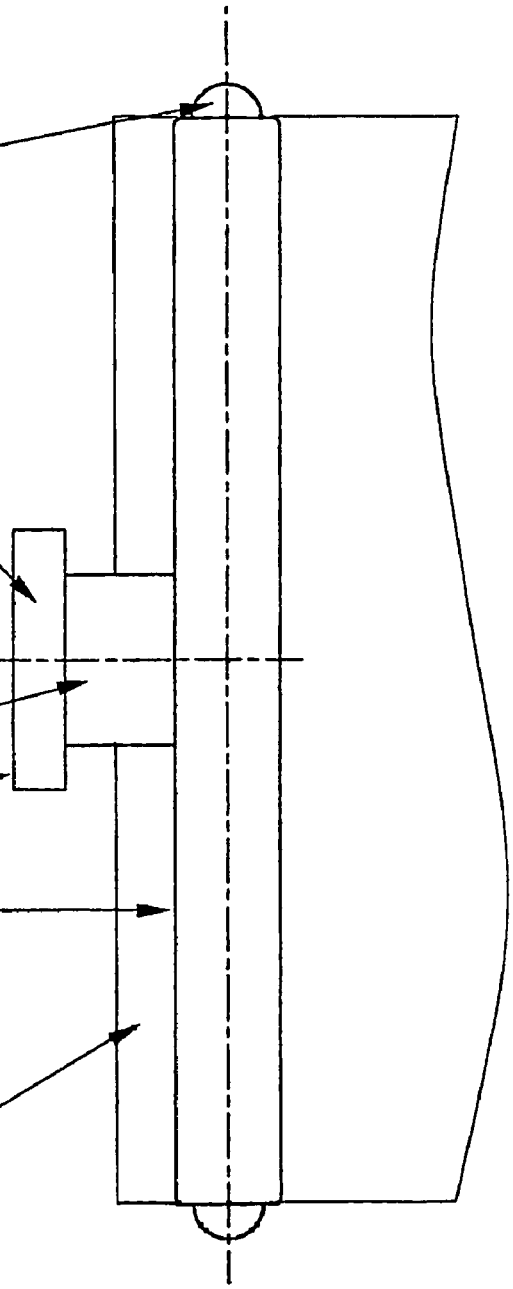
FIG. 11 is a diagrammatic elevation of a fixing element attached to a strap.

A system that makes in particular a watch reversible and interchangeable is composed of two watch cases (100, 104) joined by means such as screws (300: 303—FIG. 7), and a strap (204—FIG. 11), the ends of which are provided with two removable fixing elements (203—FIGS. 10 and 11).

Figure 8:
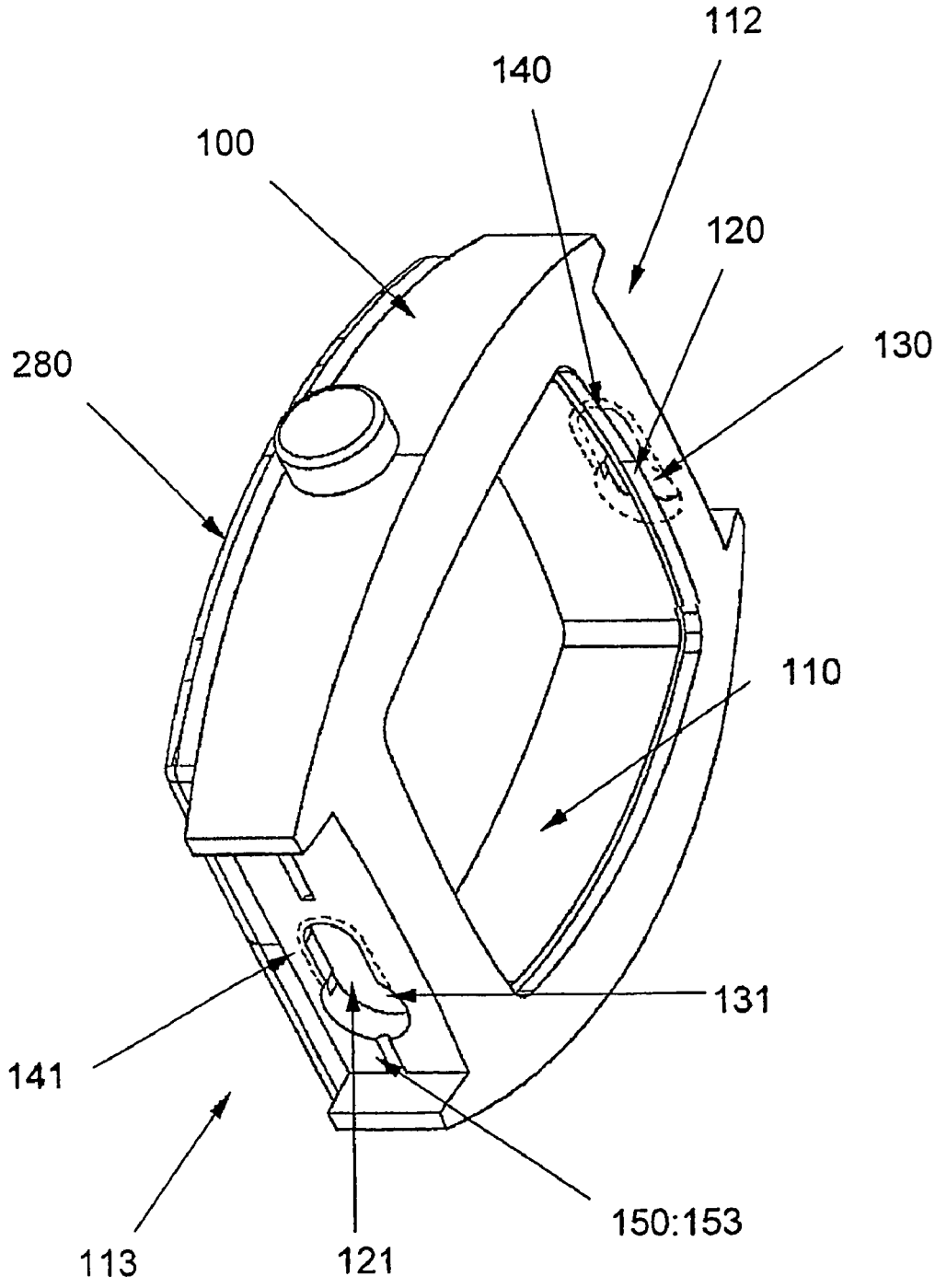
FIG. 8 is a perspective view of an assembly of a watch case and a decorative element, containing cavities for the introduction of the removable fixing elements.
Figure 9:
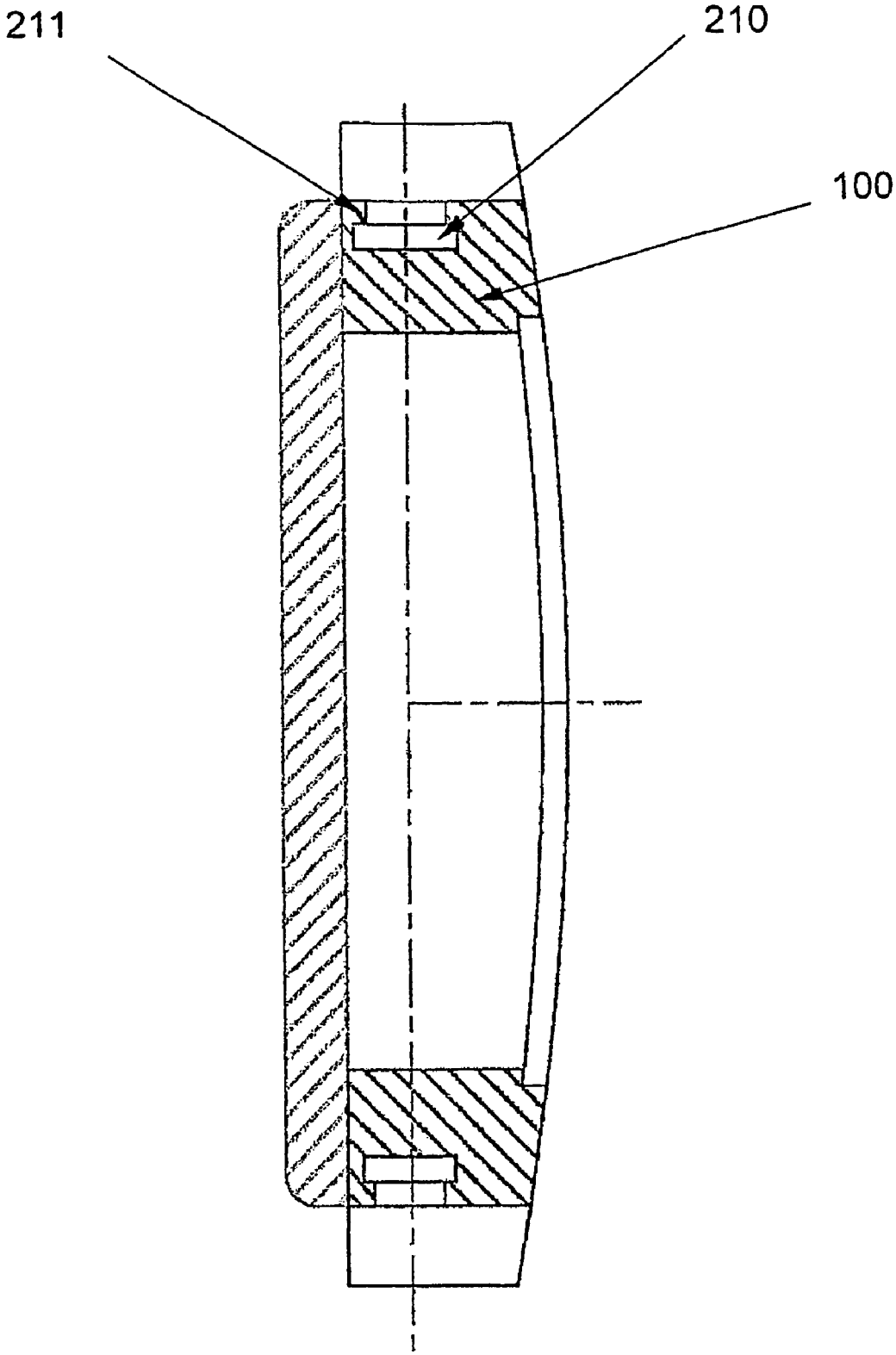
FIG. 9 is a longitudinal section through an assembly of a watch case and decorative element.

It should be observed that the device that makes in particular an object reversible and interchangeable is composed, in the case illustrated in FIG. 8, of the case (100) and of a decorative element (280).

Figure 1:
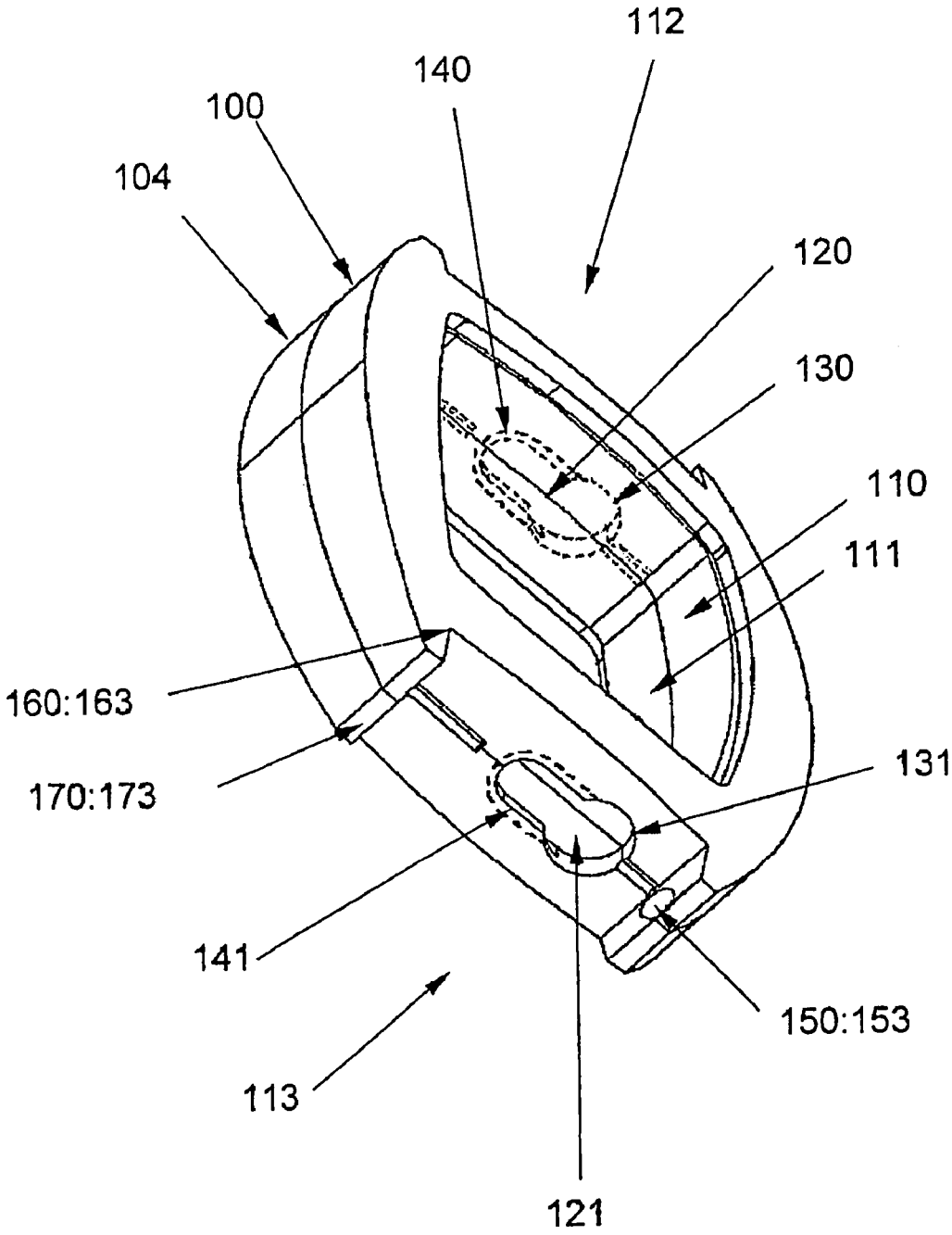
FIG. 1 shows by way of example a perspective view of an assembly of two watch cases containing cavities for the introduction of removable fixing elements.
Figure 2:
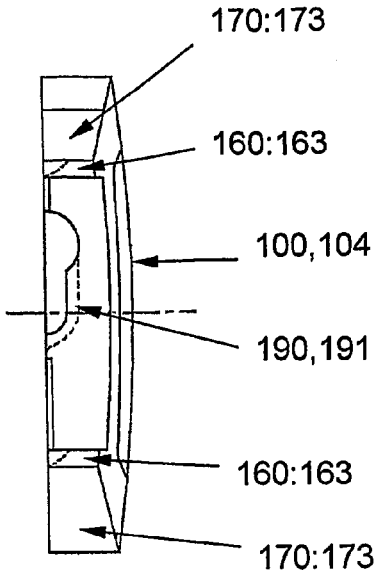
FIG. 2 is a side view of one of the watch cases of FIG. 1.

FIG. 1 shows an assembly of two middles (110, 111) of watch cases (100, 104) which forms the middle parts of the cases (100, 104) in which are placed the watch movements (not shown), which function independently.

The middles (110, 111) of the cases (100, 104) include opposing cavities (120, 121) which are milled out and consist of a circular part (130, 131), a pivot (202—FIGS. 10 and 11), and an elongate part (140, 141).

The parts (130, 131) allow the introduction of a base (210—FIGS. 10 and 11), and the parts (140, 141) are for guiding a body (211—FIGS. 10 and 11) of the pivot (202).

Cavities (150: 153) are situated in walls (160: 163) of the lugs (170: 173) and are designed to take retractable balls (200—FIGS. 10 and 11).

Figure 3:
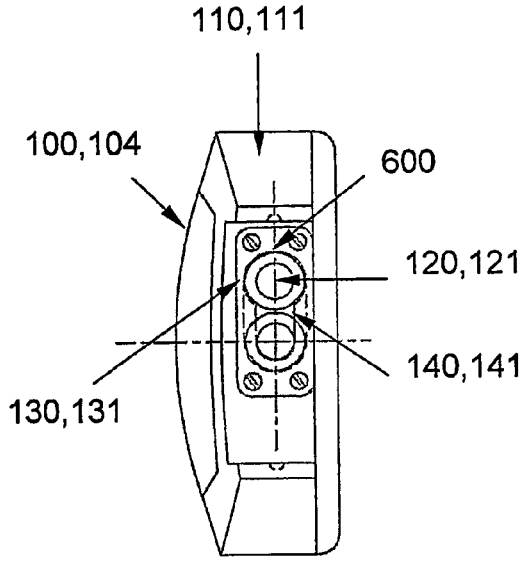
FIG. 3 is a side view of a watch case from FIG. 1 fitted with a strengthening plate.
Figure 6:
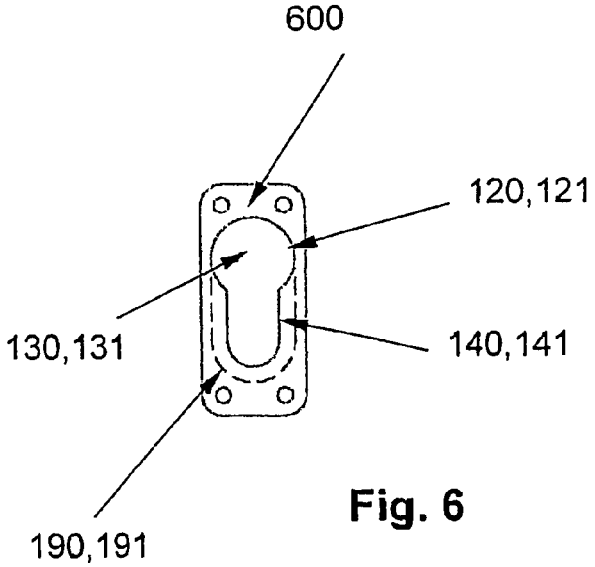
FIG. 6 shows a strengthening plate for a device allowing a watch to be reversed and interchanged.

In the version shown in FIG. 3, the cavities (120, 121) are machined in a separate plate (600—FIG. 6), generally of steel so as to strengthen the system if the material used to make the cases (100, 104) is not very strong.

Figure 12:
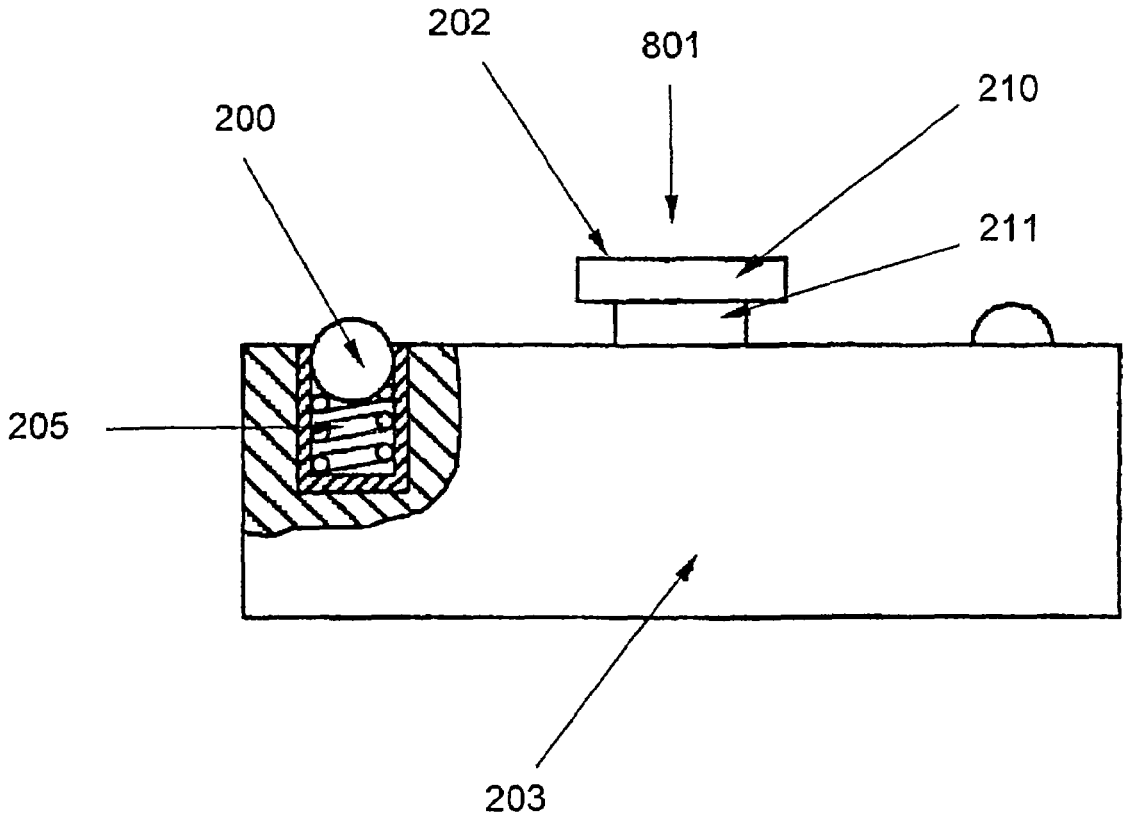
FIG. 12 shows as a variant a top view of a fixing element.

Notice that in the version illustrated in FIG. 12, the balls (200) are situated on a front face (801) of a removable fixing element (203), this requiring the cavities (150: 153) to be situated on the faces (112, 113) of the watch case (100, 104) as shown in FIG. 8.

Figure 5:
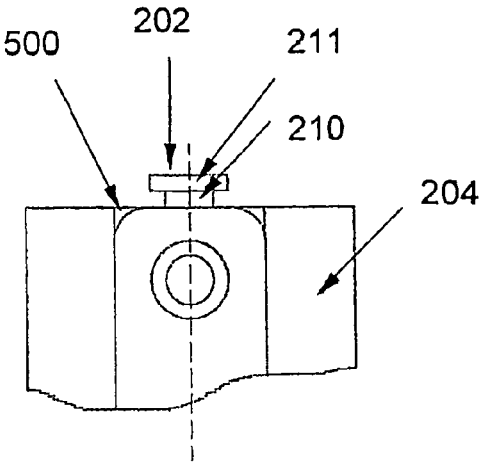
FIG. 5 is a lateral cross section through the end of a removable fixing element carrying a strap.

At the watch-carrying ends, the strap (204) has a central orifice (500—FIG. 5) on its front part (220) for the introduction of the body (211) of the pivot (202) and of a ring belonging to the strap (204) for the introduction of the removable fixing element (203). The ends to which the buckle is attached, remote from the two parts of the strap (204), are advantageously equipped with a system allowing the strap to be closed in any orientation.

The removable fixing element (203) comprises two ends, inserted into which are the retractable balls (200) pushed outward by springs (205—FIGS. 10 and 11). During assembly, the removable fixing element (203) is introduced into the ring of the strap (204). The body (211) of the pivot (202), which carries the base (210), is joined perpendicularly, through the central orifice (500) in the front part (220) of the strap (204), to the removable fixing element (203).

In the version illustrated in FIG. 12, the removable fixing element (203) is a parallelepiped in volume and the balls (200) are located on the front face (801) of the removable fixing element (203), as seen before. The removable fixing elements (203) are thus attached to the ends of the strap (204).

Figure 4:
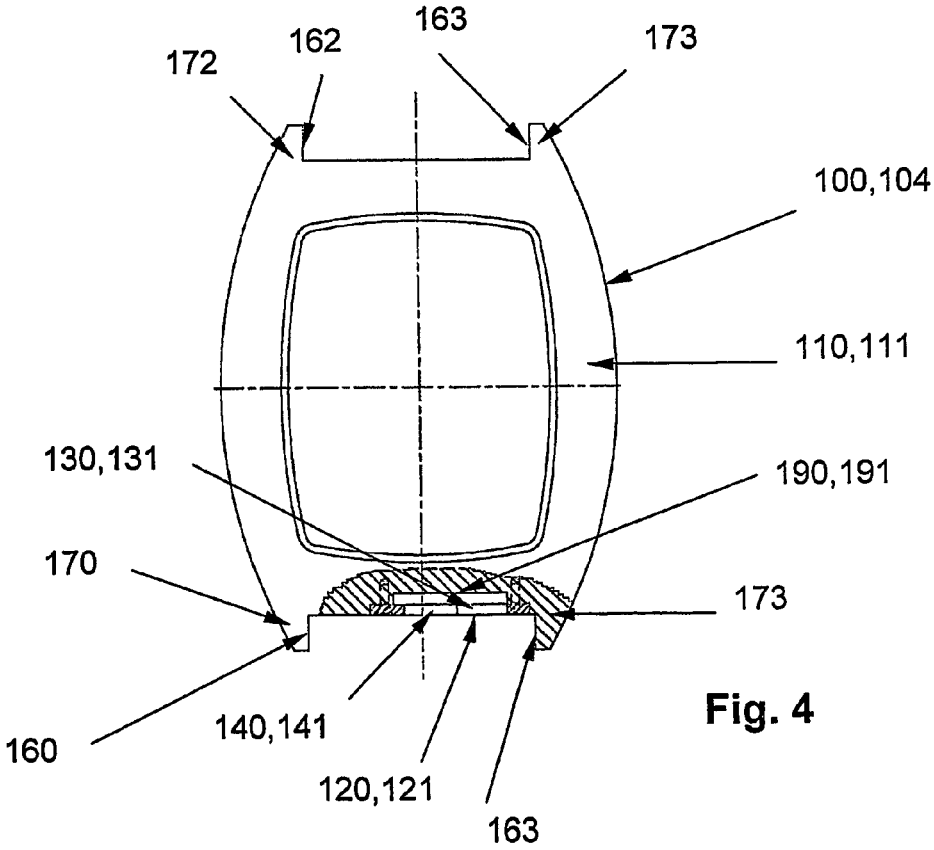
FIG. 4 is a top view of the assembly shown in FIG. 1 with a cutaway of the part containing a cavity for the introduction of a removable fixing element.

The bases (210) of the pivots (202) are inserted through the circular parts (130, 131) of the cavities (120, 121) and moved axially along recesses (190, 191-FIG. 4) situated behind the elongate parts (140, 141) which serve as guides for the bodies (211) of the pivots (202). The bases (210) thus prevent the removable fixing elements (203) from coming out of the cavities (120, 121).

When the bodies (211) of the pivots (202) reach the circular end part of the elongate parts (140, 141), a rotary movement is imparted to the removable fixing element (203) until the balls (200) enter the cavities (150: 153) and thus hold the complete system in position.

In the version illustrated in FIG. 8, the elements of the system are in particular the case (100) and the decorative element (280). The cavities (120, 121) are machined in one piece and are situated on the sides (112, 113) of the middle (110), the effect of this being to recenter longitudinally the center of gravity of said system.

It should be observed that the removable fixing element (203) of the version illustrated in FIG. 12 can be produced in all the variants adopted by the user.

The system of the present invention makes in particular a watch and a strap reversible and interchangeable, independently of each other.

The invention claimed is:

1. An assembly comprising an object, a support and, on said support, a fixing element for removably connecting said support to said object and defining a pivot axis between said object and said support in such a way that said object and said support can be reversed independently of each other, and in order to present alternately a first face and a second face of said support, said faces lying on either side of a mid-plane in a vicinity of said fixing element, when said object and said support are mutually arranged in a first or second stable position, respectively, wherein said fixing element has a pivot comprising a body connected to said support, and a base formed at its free end, and a cavity is formed on in said object, said cavity comprising a first opening designed to allow said base to be inserted into said cavity and being continued by an elongate second opening extending transversely with respect to the direction of said pivot axis and parallel to said mid-plane in a stable position, said elongate second opening being designed to guide said pivot and permit a relative movement of said object and of said support to bring them to a stable position, said support also comprising retractable locking means designed to engage with matching cavities in said stable position and to hold the assembly in said position.

2. The assembly according to claim 1, wherein said locking means comprise at least one retractable ball.

3. The assembly according to claim 2, wherein said ball is retractable along an axis parallel to said pivot axis.

4. The assembly according to claim 3, wherein said object is a watch case comprising a middle in which two cavities are formed, and wherein said support is a strap having two free ends, each carrying a fixing element.

5. The assembly according to claim 4, wherein said watch case comprises two middles joined together.

6. The assembly according to claim 2, wherein said object is a watch case comprising a middle in which two cavities are formed, and wherein said support is a strap having two free ends, each carrying a fixing element.

7. The assembly according to claim 6, wherein said middle has lugs containing said cavities, and wherein said ball is retractable along an axis perpendicular to said pivot axis.

8. The assembly according to claim 7, wherein said pivot axis is situated halfway between said lugs.

9. The assembly according to claim 6, wherein said watch case comprises two middles joined together.

10. The assembly according to claim 2, wherein said cavity is formed in a plate which is fixed to said object.

11. The assembly according to claim 1, wherein said object is a watch case comprising a middle in which two cavities are formed, and wherein said support is a strap having two free ends, each carrying a fixing element.

12. The assembly according to claim 11, wherein said middle has lugs containing said cavities, and wherein said locking means comprise at least one retractable ball which is retractable along an axis perpendicular to said pivot axis.

13. The assembly according to claim 12, wherein said pivot axis is situated halfway between said lugs.

14. The assembly according to claim 13, wherein said watch case comprises two middles joined together.

15. The assembly according to claim 12, wherein said watch case comprises two middles joined together.

16. The assembly according to claim 11, wherein said watch case comprises two middles joined together.

17. The assembly according to claim 11, wherein said cavity is formed in a plate which is fixed to said object.

18. The assembly according to claim 1, wherein said cavity is formed in a plate which is fixed to said object.

19. The assembly according to claim 18, wherein said plate is screwed to said object.

20. The assembly according to claim 17, wherein said plate is screwed to said object.

* * * * *